US010032585B2

(12) United States Patent
Takaya et al.

(10) Patent No.: US 10,032,585 B2
(45) Date of Patent: Jul. 24, 2018

(54) ELECTROMAGNETIC CONTACTOR

(71) Applicant: FUJI ELECTRIC FA COMPONENTS & SYSTEMS CO., LTD., Tokyo (JP)

(72) Inventors: Kouetsu Takaya, Kounosu (JP); Yuki Tashima, Kounosu (JP); Hideo Adachi, Fukaya (JP); Yasuhiro Naka, Kitamoto (JP); Koujun Konishi, Kounosu (JP)

(73) Assignee: FUJI ELECTRIC FA COMPONENTS & SYSTEMS CO., LTD., Tokyo (JP)

( * ) Notice: Subject to any disclaimer, the term of this patent is extended or adjusted under 35 U.S.C. 154(b) by 0 days.

(21) Appl. No.: 15/450,784

(22) Filed: Mar. 6, 2017

(65) Prior Publication Data

US 2018/0158634 A1 Jun. 7, 2018

(30) Foreign Application Priority Data

Dec. 2, 2016 (JP) ..... 2016-235206

(51) Int. Cl.
*H01H 9/30* (2006.01)
*H01H 50/02* (2006.01)
(Continued)

(52) U.S. Cl.
CPC ..... *H01H 50/021* (2013.01); *H01H 47/223* (2013.01); *H01H 50/023* (2013.01); *H01H 50/443* (2013.01)

(58) Field of Classification Search
CPC ..... H01H 3/28; H01H 9/00; H01H 67/02
(Continued)

(56) References Cited

U.S. PATENT DOCUMENTS 4,931,757 A * 6/1990 Lemmer ..... H01H 89/06 335/131
5,243,160 A * 9/1993 Ohno ..... H01H 33/565 218/84
(Continued)

FOREIGN PATENT DOCUMENTS

CN 201087896 Y 7/2008
EP 2871662 A1 5/2015
(Continued)

OTHER PUBLICATIONS

Europe Patent Office, "Search Report for European Patent Application No. 17160505.8," dated Oct. 11, 2017.
(Continued)

*Primary Examiner* — Shawki S Ismail
*Assistant Examiner* — Lisa Homza
(74) *Attorney, Agent, or Firm* — Manabu Kanesaka

(57) ABSTRACT

There is provided an electromagnetic contactor which can easily and inexpensively change the DC operation type to the AC operation type. The electromagnetic contactor includes an electromagnet that opens and closes a contact by using DC excitation of a coil, a lower case that accommodates the electromagnet, external coil terminals that are disposed in the lower case beside the electromagnet, and a substrate that is accommodated in the lower case, and that has a rectifier circuit whose input side is connected to the external coil terminals and whose output side is connected to the coil so as to output a DC after converting an input AC to the DC. An inner surface of the lower case has a groove between the electromagnet and the external coil terminals. The substrate is held by being inserted into the groove.

12 Claims, 8 Drawing Sheets

(51) Int. Cl.
*H01H 47/22* (2006.01)
*H01H 50/44* (2006.01)

(58) Field of Classification Search
USPC ..... 335/201
See application file for complete search history.

(56) References Cited

U.S. PATENT DOCUMENTS

| | | | | |
|---|---|---|---|---|
| 8,461,950 | B2 * | 6/2013 | Lim | H01H 50/546 335/126 |
| 9,673,010 | B2 * | 6/2017 | Lee | H01H 50/56 |
| 9,754,749 | B2 * | 9/2017 | Son | H01H 50/56 |
| 2009/0080133 | A1 | 3/2009 | Chaudhuri et al. | |
| 2009/0237190 | A1 | 9/2009 | Nyzner | |
| 2012/0090166 | A1 * | 4/2012 | Yeon | H01H 11/00 29/622 |
| 2012/0091103 | A1 * | 4/2012 | Yeon | H01H 50/023 218/154 |
| 2012/0092100 | A1 * | 4/2012 | Choi | H01H 51/065 335/192 |
| 2015/0048908 | A1 * | 2/2015 | Isozaki | H01H 1/54 335/6 |
| 2015/0130569 | A1 * | 5/2015 | Jang, Il | H01H 3/28 335/192 |
| 2015/0179359 | A1 * | 6/2015 | Yeom | H01H 3/28 335/196 |

FOREIGN PATENT DOCUMENTS

| | | | |
|---|---|---|---|
| FR | 2737604 | A1 | 2/1997 |
| JP | S59-59452 | U | 4/1984 |
| JP | S61-114883 | U | 7/1986 |
| JP | S62-123623 | A | 6/1987 |
| JP | H04-115739 | U | 10/1992 |
| JP | H09-045204 | A | 2/1997 |
| JP | 2009-076457 | A | 4/2009 |
| JP | 2015-109180 | A | 6/2015 |

OTHER PUBLICATIONS

Japan Patent Office, "Office Action for Japanese Patent Application No. 2016-235206," dated Aug. 22, 2017.
Japan Patent Office, "Office Action for Japanese Patent Application No. 2016-235206," dated Apr. 4, 2017.

* cited by examiner

ELECTROMAGNETIC CONTACTOR

BACKGROUND OF THE INVENTION

Field of the Invention

The present invention relates to an electromagnetic contactor.

CROSS REFERENCE TO RELATED APPLICATIONS AND INCORPORATION BY REFERENCE

This application claims benefit of priority under 35 USC 119 based on Japanese Patent Application No. 2016-117918 filed on Jul. 14, 2016, the entire contents of which are incorporated by reference herein.

Description of the Related Art

Depending on whether an electromagnetic contactor is a DC operation type or an AC operation type, basic configurations such as structures and winding specifications of an electromagnet are different from each other. However, as disclosed in PTL 1, the DC operation type can be changed to the AC operation type by using a rectifier circuit which converts an AC into a DC. A substrate having the rectifier circuit formed therein is fixed to a mounting table by a resin casting agent in a state where a dedicated terminal plate is mounted on the substrate.

CITATION LIST

Patent Literature

PTL 1: JPU-A-H4-115739

SUMMARY OF THE INVENTION

Even if the DC operation type is used as it is, or even if the AC operation type is used after the DC operation type is changed, it is desirable to share mutual configurations as many as possible, and it is preferable to avoid a significant change in existing configurations. In particular, in a case of an electromagnetic contactor having a capsule structure hermetically filled with arc-extinguishing gas, it is not preferable to change a basic configuration including the capsule structure. Therefore, as disclosed in PTL 1 described above, if the dedicated terminal plate is disposed in the substrate or the substrate is fixed by the resin casting agent in order to change the DC operation type to the AC operation type, there is a possibility of increased cost and poor workability. In this regard, there is room for improvement.

An object of the present invention is to provide an electromagnetic contactor which can easily and inexpensively change the DC operation type to the AC operation type.

An electromagnetic contactor according to an aspect of the present invention includes a contact accommodating portion that accommodates a contact, and that is hermetically filled with arc-extinguishing gas, an electromagnet that opens and closes the contact by using DC excitation of a coil, a case that accommodates the contact accommodating portion and the electromagnet, an external coil terminal that is disposed in the case beside the electromagnet, and a substrate that is accommodated in the case, and that has a rectifier circuit whose input side is connected to the external coil terminal and whose output side is connected to the coil so as to output a DC after converting an input AC into the DC. An inner surface of the case has a groove between the electromagnet and the external coil terminal. The substrate is held by being inserted into the groove.

According to the present invention, a DC operation type can be easily and inexpensively changed to an AC operation type simply by interposing a substrate between an electromagnet and an external coil terminal and inserting the substrate into a groove of a case.

DESCRIPTION OF THE PREFERRED EMBODIMENTS

Hereinafter, embodiments according to the present invention will be described with reference to the drawings. The drawings are schematically provided, and may differently illustrate actual elements in some cases. In addition, the embodiments described below provide an example of a device and a method for embodying the technical idea of the present invention. The configuration is not specified by the following description. The technical idea of the present invention can be modified in various ways within the technical scope disclosed in claims.

<<Configuration>>

Figure 1:
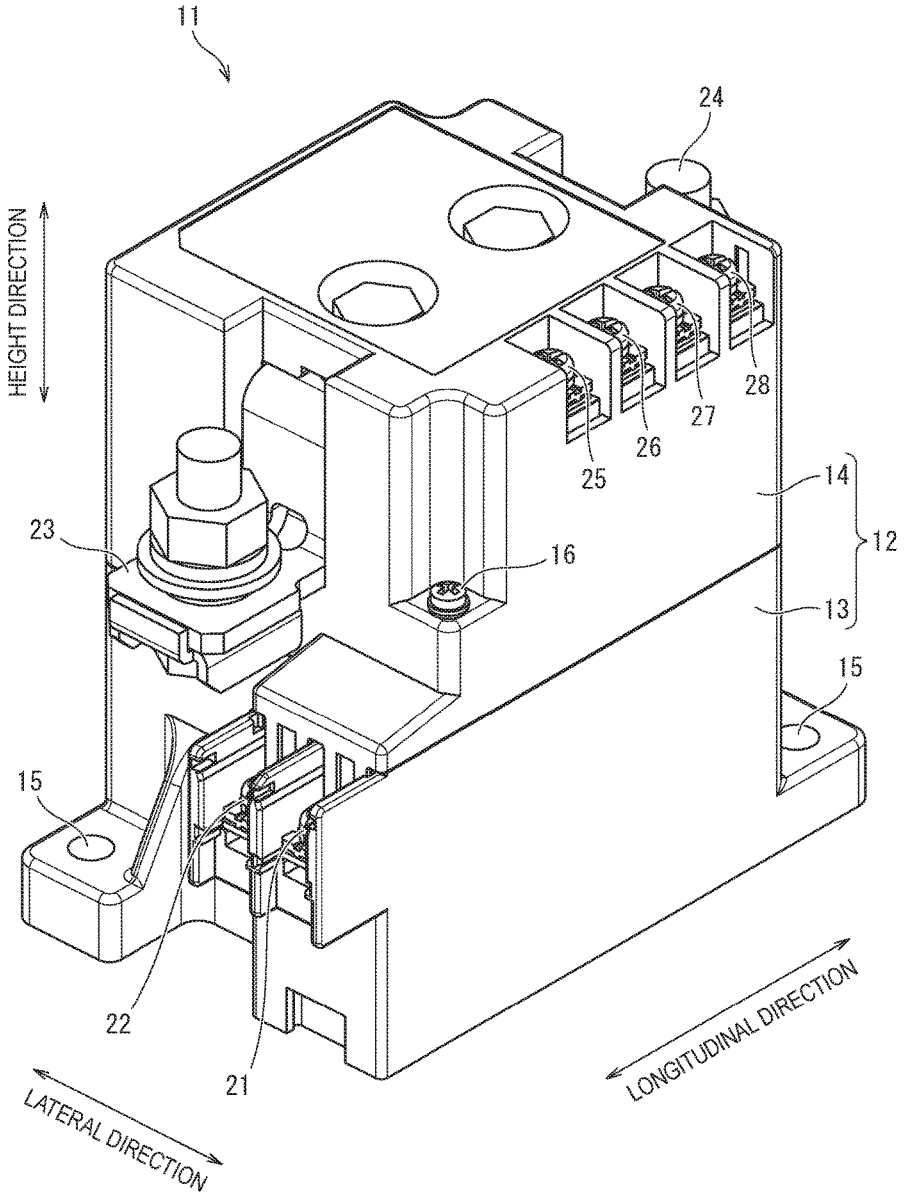
FIG. 1 is a perspective view illustrating an outer configuration of an electromagnetic contactor.

FIG. 1 is a perspective view illustrating an outer configuration of an electromagnetic contactor.

In the following description, for the convenience of understanding, three directions orthogonal to each other in a space are respectively referred to as a longitudinal direction, a lateral direction, and a height direction.

An electromagnetic contactor 11 opens and closes an electric path of a DC load, and is unitized by a case 12 having a substantially rectangular parallelepiped shape. The case 12 includes a lower case 13 and an upper case 14 which are separable in the height direction. An outer side of the lower case 13 has mounting holes 15 at one location on one end side and two locations on the other end side in the longitudinal direction. The lower case 13 is fixed at a predetermined mounting position by screws inserted into the mounting holes 15. The lower case 13 is formed in a box shape whose upper end side is open, and the upper case 14 is formed in a box shape whose lower end side is open. In a state where the upper end side of the lower case 13 and the lower end side of the upper case 14 are fitted to each other, both of these are tightened by a screw 16. The electromagnetic contactor 11 is attached to a vertical surface in a state where one end side in the longitudinal direction faces upward in a vertical direction.

A pair of external coil terminals 21 and 22 sequentially arranged from one end side toward the other end side in the lateral direction is disposed on one end side in the longitudinal direction in the lower case 13. An electric cable wired for an operation circuit is connected to the external coil terminals 21 and 22 via a crimp terminal or by being pinched between core wires.

External main terminals 23 and 24 are disposed on one end side and the other end side in the longitudinal direction in the upper case 14. A power source side electric cable wired for a main circuit is connected to the external main terminal 23 via a crimp terminal, and a load side electric cable wired for a main circuit is connected to the external main terminal 24 via a crimp terminal.

First external auxiliary terminals 25 and 26 and second external auxiliary terminals 27 and 28, which are sequentially arranged from one end side toward the other end side in the longitudinal direction, are disposed on one end side in the lateral direction in the upper case 14. Electric cables wired for an auxiliary circuit forming an a-contact or a b-contact are respectively connected to the first external auxiliary terminals 25 and 26, and the second external auxiliary terminals 27 and 28 via a crimp terminal or by being pinched between core wires.

Figure 2:
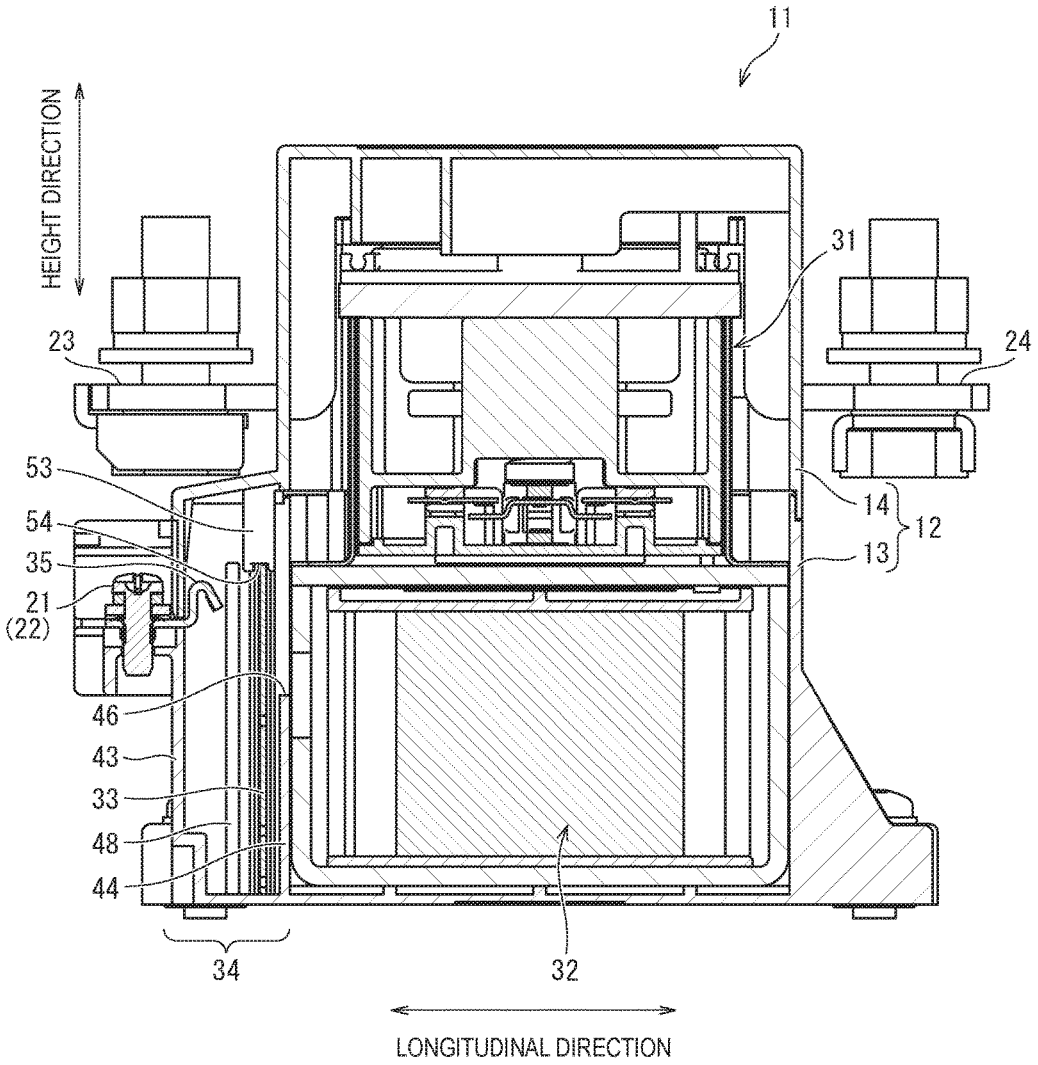
FIG. 2 is a sectional view of the electromagnetic contactor.

FIG. 2 is a sectional view of the electromagnetic contactor.

The case 12 accommodates a contact accommodating portion 31, an electromagnet 32, and a substrate 33. The electromagnet 32 and the substrate 33 disposed on one end side in the longitudinal direction in the electromagnet 32 are disposed inside the lower case 13. The contact accommodating portion 31 disposed on the electromagnet 32 is disposed inside the upper case 14.

The contact accommodating portion 31 accommodates a main contact, an auxiliary contact, and a movable iron core for operating the main contact and the auxiliary contact, and has a capsule structure which is hermetically filled with arc-extinguishing gas.

The electromagnet 32 is formed in such a way that a coil is wound around a coil frame internally having a fixed iron core, and opens and closes the main contact and the auxiliary contact in such a way that the movable iron core of the contact accommodating portion 31 is attracted using DC excitation of the coil.

The substrate 33 has a substantially rectangular shape, and disposed between the electromagnet 32 and the external coil terminals 21 and 22. The substrate 33 is held by the lower case 13 so that a plane direction is parallel to the height direction and the lateral direction. Within the lower case 13, a portion accommodating the substrate 33 functions as a substrate accommodating portion 34. The substrate 33 has a rectifier circuit (diode bridge) which converts an input AC into a DC and outputs the DC. An input side of the substrate 33 is connected to a connection conductor 35 of the external coil terminals 21 and 22 via a pair of lead wires, and an output side thereof is connected to both ends of the coil via a pair of lead wires. In the connection conductor 35, a distal end side is tightened by a terminal screw, and a core wire of the lead wire on a proximal end side is pinched and crimped. An electric component such as a diode and a variable resistor is mounted on one end side (one surface side) in the longitudinal direction in the substrate 33.

Figure 3:
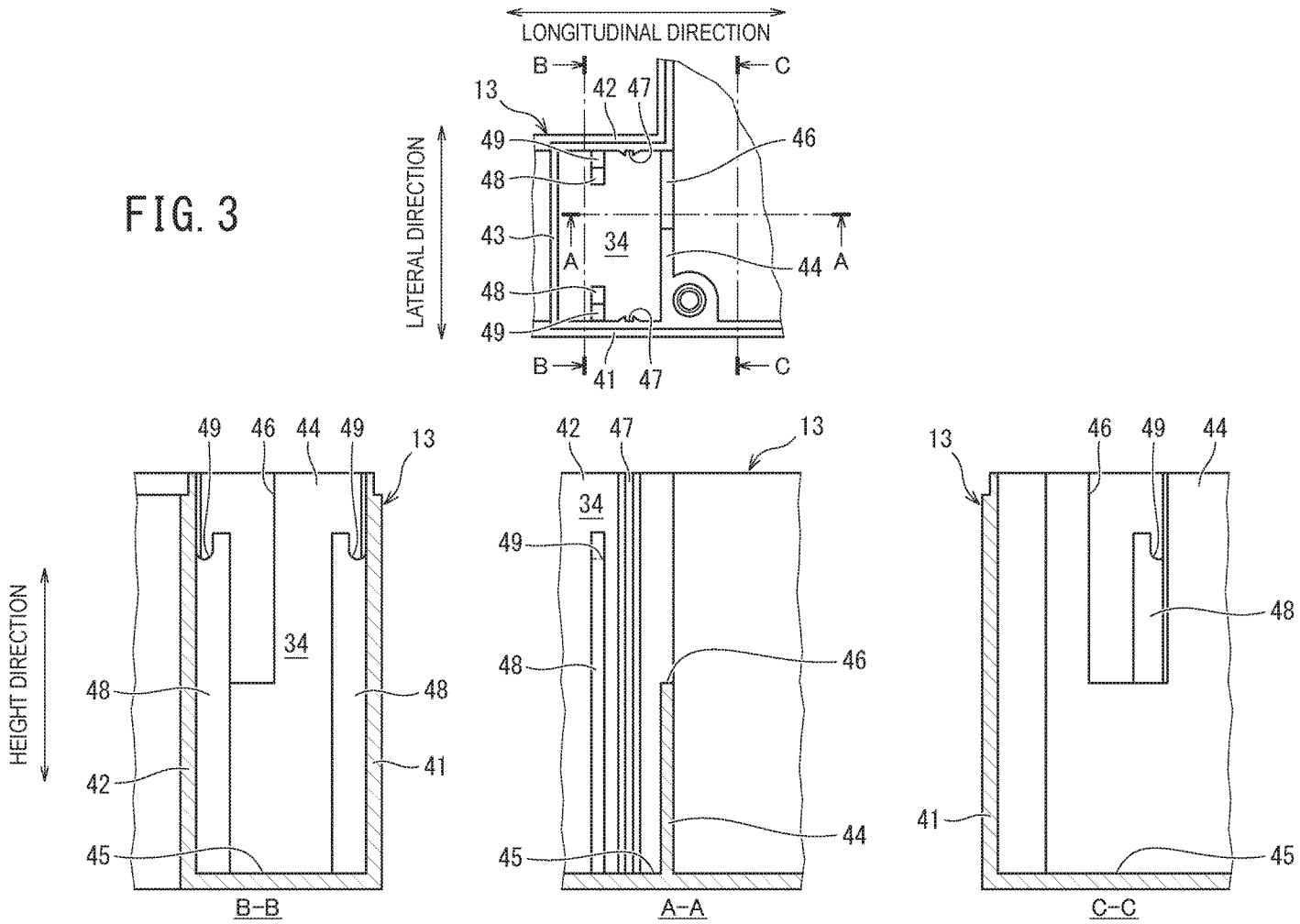
FIG. 3 is a plan view and a sectional view of a substrate accommodating portion, which illustrate a state before a substrate is inserted.

FIG. 3 is a plan view and a sectional view of the substrate accommodating portion, which illustrate a state before the substrate is inserted.

The substrate accommodating portion 34 is partitioned by side walls 41, 42, and 43 formed in the lower case 13, and a partition wall 44.

The side walls 41 and 42 are parallel to the longitudinal direction and the height direction, and inner surfaces thereof face each other in the lateral direction. The side walls 41 and 42 extend from a floor 45 to an upper end of the lower case 13 in the height direction. An interval (inner dimension) between the side walls 41 and 42 corresponds to a dimension in the lateral direction in the substrate 33. The side wall 43 is disposed between the substrate 33 and the external coil terminals 21 and 22, and is parallel to the lateral direction and the height direction. The side wall 43 is formed to be continuous with each one end in the longitudinal direction in the side walls 41 and 42, and extends from the floor 45 to the center of the lower case 13 in the height direction. The partition wall 44 is disposed between the electromagnet 32 and the substrate 33, and is parallel to the lateral direction and the height direction. The partition wall is formed to be continuous from the inner surface of the side walls 41 and 42, and extends from the floor 45 to the upper end of the lower case 13 in the height direction.

An upper portion of the partition wall 44 has a rectangular opening 46. The opening 46 extends from the center to an upper end of the partition wall 44 in the height direction, and extends from the center to the other end of the partition wall 44 in the lateral direction. The substrate accommodating portion 34 is open to the electromagnet 32 side through the opening 46.

The inner surfaces of the side walls 41 and 42 respectively have a pair of mutually facing grooves 47 extending linearly along the height direction. Specifically, a pair of rail-shaped projections is formed on a wall surface, thereby forming one groove 47. The groove 47 extends from the floor 45 to the upper end of each side wall. A width dimension of the groove 47 corresponds to a thickness of the substrate 33.

The inner surfaces of the side walls 41 and 42 respectively have a plate-shaped rib 48 parallel to the lateral direction and the height direction, between the groove 47 and the side wall 43. The rib 48 is formed to be narrowed in the lateral direction so as not to interfere with an electronic component of the substrate 33, and extends from the floor 45 to the upper end of each side wall (lower than the upper end). A recess 49 including a U-shaped notch which is recessed along the lateral direction is formed in the entire thickness direction (longitudinal direction) in an upper end of the rib 48. Although not illustrated in a plane view or a sectional view taken along line A-A, a corner at which a side surface of the recess 49 and the surface of the rib 48 intersect, and a corner at which a bottom surface of the recess 49 and the surface of the rib 48 intersect are chamfered. In the recess 49, a width dimension in the lateral direction is set to a slightly narrower range than an outer diameter of the coated lead wire which connects the substrate 33 and the connection conductor 35 to each other. That is, if the width dimension of the recess 49 is too narrow, there is a possibility of damage to the coating of the lead wire. Accordingly, the width dimension is set to such a degree that the fitted lead wire can be held.

Figure 4:
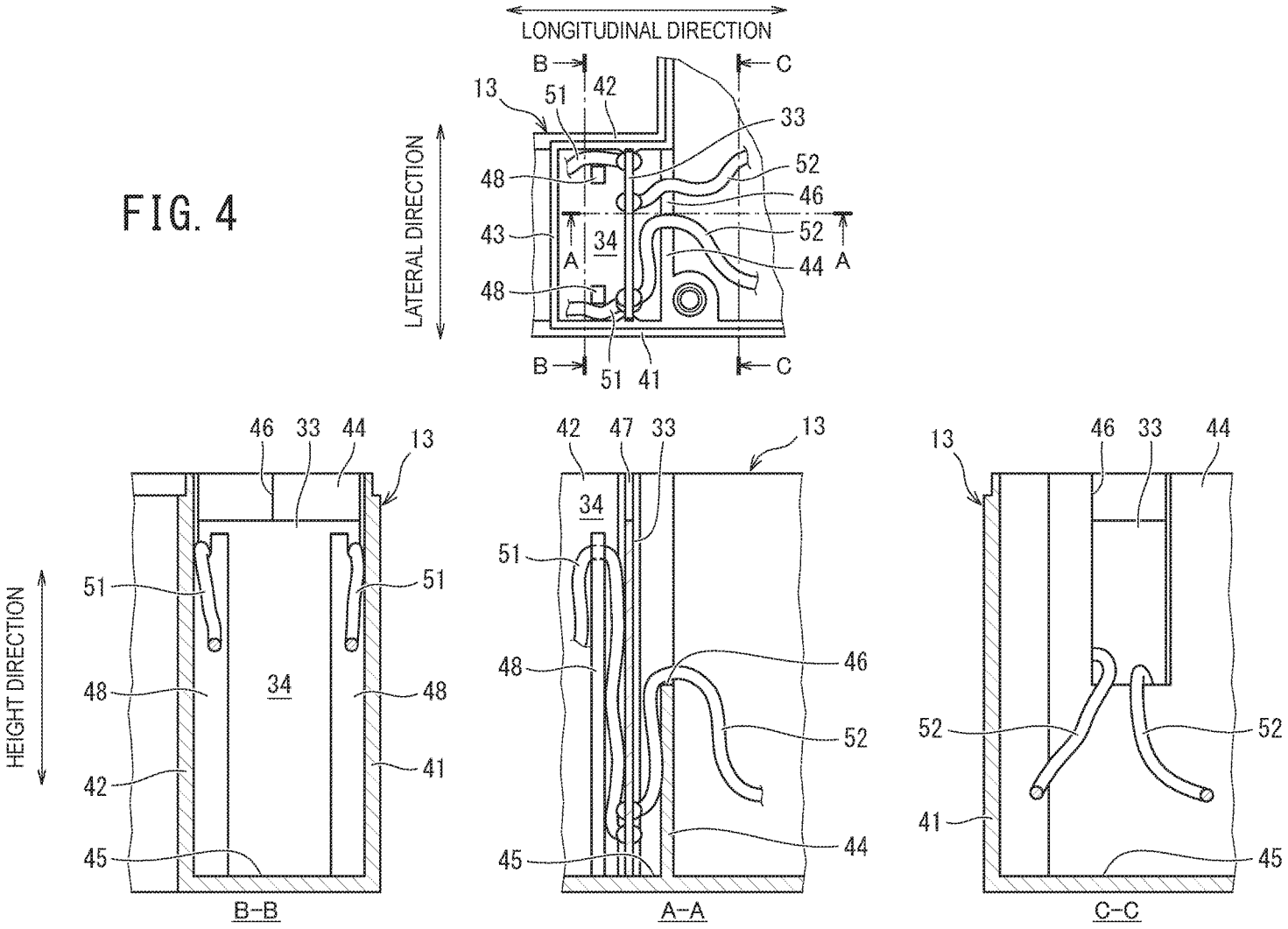
FIG. 4 is a plan view and a sectional view of the substrate accommodating portion, which illustrate a state after the substrate is inserted.

FIG. 4 is a plan view and a sectional view of the substrate accommodating portion, which respectively illustrate a state after the substrate is inserted.

The substrate 33 is held by the lower case 13 in such a way that both end side edges in the lateral direction are inserted into the pair of grooves 47. A fitting degree between the substrate 33 and the groove 47 is set within a range which can restrain rattling of the substrate 33. That is, the dimension and the thickness in the lateral direction of the substrate 33, and the width dimension and the depth of the groove 47 are set to such a degree that the inserted substrate 33 can be held. The substrate 33 is inserted to reach a position where the lower end comes into contact with the floor 45. A pair of lead wires 51 is soldered on one end side (one surface side) in the longitudinal direction in the substrate 33, and a pair of lead wires 52 is soldered on the other end side (the other surface side) in the longitudinal direction.

In each of the pair of lead wires 51 serving as an input side, a proximal end side is soldered at a position facing the rib 48. The pair of lead wires 51 is held so as not to be freely movable in such a way that the lead wire 51 is fitted into the recess 49 when the lead wire 51 exceeds the rib 48 while facing upward along a gap between the substrate 33 and the rib 48. The lead wires 51 are disposed on the external coil terminals 21 and 22, and each distal end is connected to the connection conductor 35 of the external coil terminals 21 and 22. On the other hand, in each of the pair of lead wires 52 serving as an output side, a proximal end side is soldered at a position facing the partition wall 44, and faces upward along a gap between the substrate 33 and the partition wall 44. The pair of lead wires 52 exceeds the partition wall 44 via the opening 46, and is connected to the electromagnet 32 side. Each distal end is connected to both ends of the coil.

Figure 5:
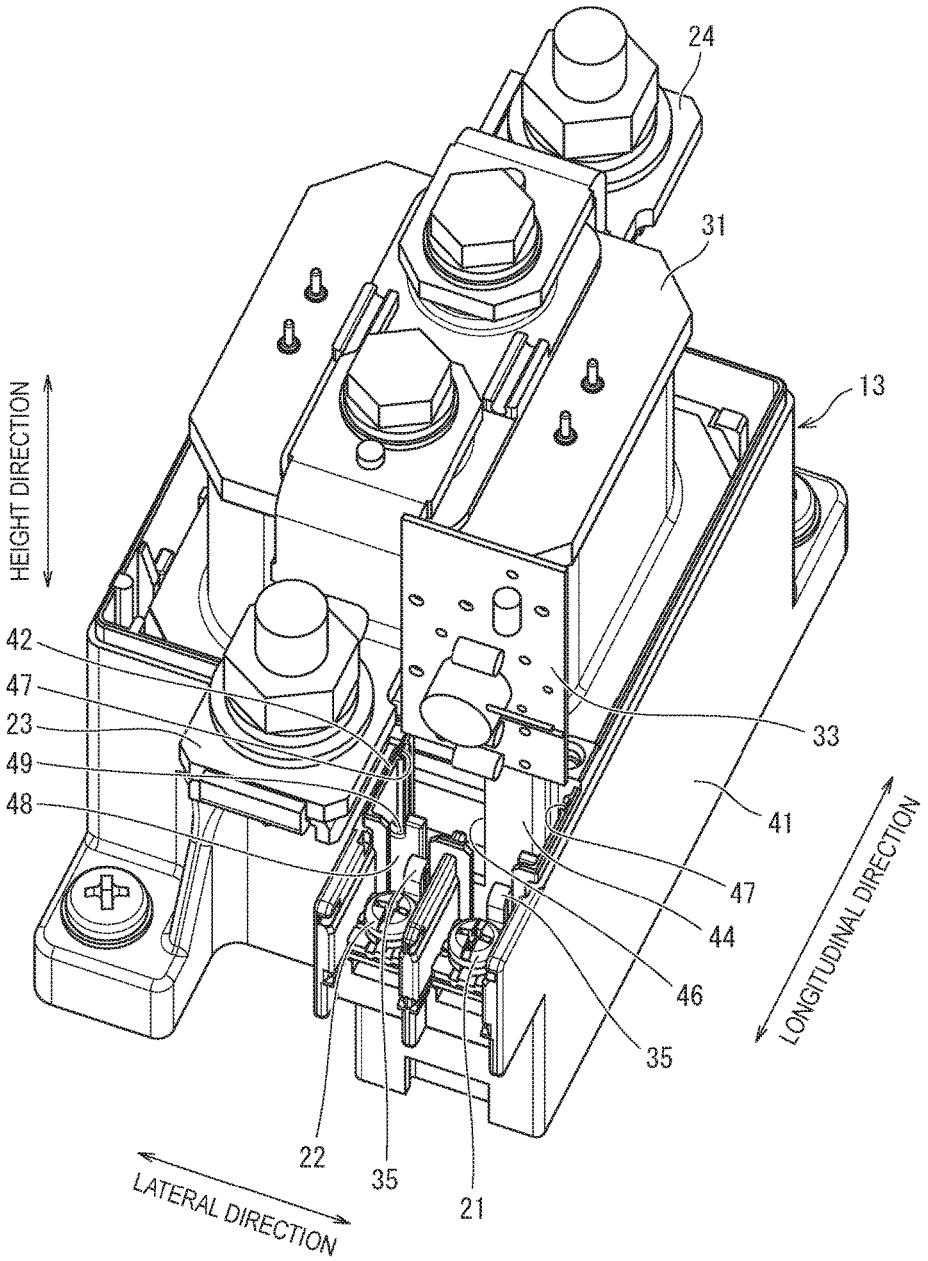
FIG. 5 is a perspective view illustrating a state before the substrate is inserted.

FIG. 5 is a perspective view illustrating a state before the substrate is inserted.

Here, illustration of the lead wires 51 and 52 is omitted, and a state is illustrated where the substrate 33 starts to be inserted into the pair of grooves 47 from above.

Figure 6:
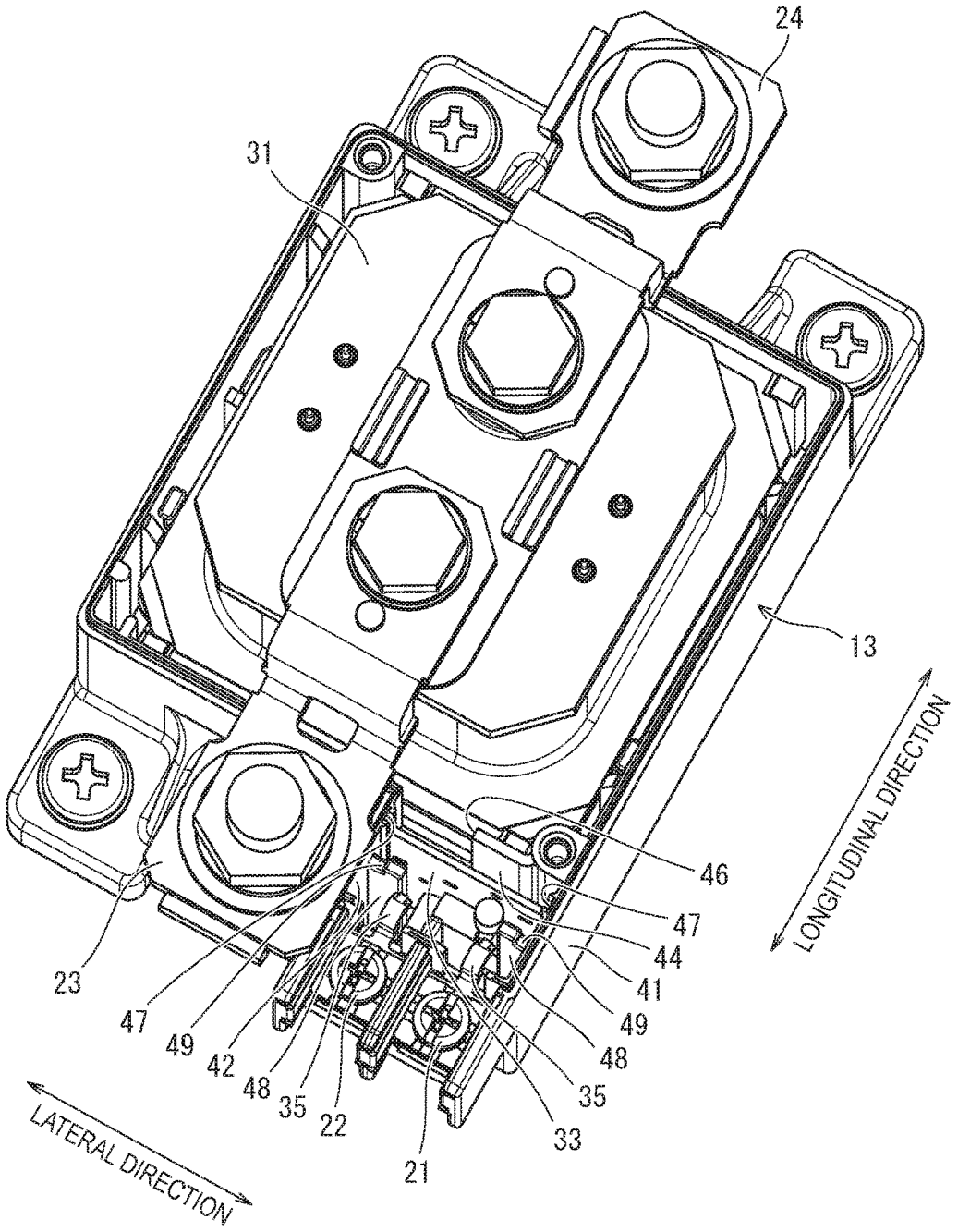
FIG. 6 is a perspective view illustrating a state after the substrate is inserted.

FIG. 6 is a perspective view illustrating a state after the substrate is inserted.

Here, illustration of the lead wires 51 and 52 is omitted, and a state is illustrated where the substrate 33 is firmly held by the lower case 13 in such a way that both end edges in the substrate 33 are inserted into the pair of grooves 47.

Figure 7:
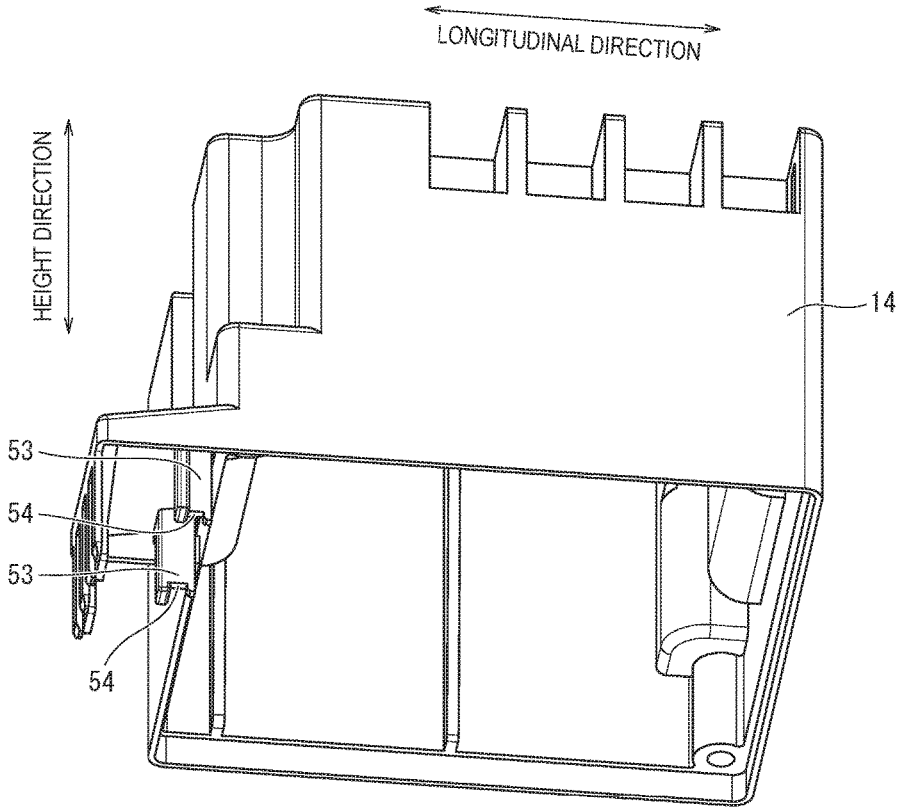
FIG. 7 is a perspective view illustrating a rear side of an upper case.

FIG. 7 is a perspective view illustrating a rear side of the upper case.

The inner side of the upper case 14 has a pair of claw portions 53 protruding downward. A lower end of the claw portion 53 has a recess 54 formed entirely in the lateral direction, which is recessed along the longitudinal direction. The pair of claw portions 53 is disposed so that the recess 54 pushes both end sides in the lateral direction in the substrate 33 from above when the upper case 14 is fitted to the lower case 13. Therefore, when the substrate 33 is inserted into the lower case 13 and the upper case 14 is fitted to the lower case 13, an arrangement and a dimension in the height direction of the claw portions 53, and the depth of the recess 54 are set in accordance with the position and the height of the substrate 33.

<<Operation>>

Next, an operation according to the embodiment will be described.

The inner surface of the lower case 13 has the pair of facing grooves 47 between the electromagnet 32 and the external coil terminals 21 and 22. The substrate 33 which converts the input AC to the DC and outputs the DC is held by both end edges being inserted into the pair of grooves 47. Therefore, the electromagnet 32 is a type operated by the DC excitation. The substrate 33 is interposed between the electromagnet 32 and the external coil terminals 21 and 22. The DC operation type can be easily changed to the AC operation type simply by inserting the substrate 33 into the groove of the lower case 13. That is, in the existing configuration used in the related art, the substrate accommodating portion 34 may be disposed in the lower case 13.

Therefore, compared to a case where the substrate having the rectifier circuit is disposed, and the dedicated terminal plate is disposed in the substrate or the substrate is fixed by the resin casting agent in order to change the DC operation type to the AC operation type, it is possible to restrain increased cost and poor workability. That is, the DC operation type can be easily and inexpensively changed to the AC operation type. In a case where the DC operation type is used as it is without a need to change the DC operation type to the AC operation type, the substrate 33 may be omitted, and the connection conductor 35 of the external coil terminals 21 and 22 may be simply connected to the coil of the electromagnet 32. In this way, even if the DC operation type is used as it is, or even if the AC operation type is used after the DC operation type is changed, it is desirable to share mutual configurations as many as possible. In addition, it is not necessary to significantly change the existing configurations. In particular, it is not necessary to change a basic configuration including the contact accommodating portion 31 which is hermetically filled with the arc-extinguishing gas.

The substrate 33 is firmly held since two sides on both end sides are supported by the pair of grooves 47 and the lower end is also in contact with the floor 45. Furthermore, the inner side of the upper case 14 has the pair of claw portions 53. If the upper case 14 is fitted to the lower case 13, the recess 54 of the claw portion 53 can push both end sides of the substrate 33 from above. Therefore, even if the contact is operated or vibrations are generated from the outside, it is possible to reliably restrain rattling or slack of the substrate 33.

In addition, the recess 49 is formed in the rib 48 of the lower case 13, and the lead wire 51 is fitted into the recess 49 so as to be held by the recess 49. Accordingly, even if the contact is operated or vibrations are generated from the outside, it is possible to restrain the lead wire 51 from being moved. Therefore, it is possible to restrain the lead wire 51 from being rubbed, or to restrain metal fatigue of the core wire.

When assembling work is carried out, if the substrate 33 is inserted into the pair of grooves 47, the lead wire 51 located on the input side is raised upward along the rib 48, and the lead wire 52 located on the output side is raised upward along the partition wall 44. Therefore, if the lead wires 51 and 52 soldered to the substrate 33 are accustomed to rise upward from the root, the substrate 33 is easily inserted into the grooves 47.

The recess 49 is formed in the upper end of the rib 48, and a U-shaped notch is open upward. Therefore, when the substrate 33 is inserted into the pair of grooves 47, if the lead wire 51 raised upward along the rib 48 is pressed into the recess 49 from above, the lead wire 51 can be easily fitted into the recess 49, thereby providing excellent workability. Furthermore, the lead wire 51 can be held by the recess 49. Accordingly, when the upper case 14 is fitted to the lower case 13, the coating of the lead wire 51 can be prevented from being damaged since the lead wire 51 is pinched at a position where both of these are fitted together.

The opening 46 is not a hole penetrating the partition wall 44, and is open upward in a recessed shape. Therefore, when the substrate 33 is inserted into the pair of grooves 47, the lead wire 52 raised upward along the partition wall 44 can be wired from above. That is, the lead wire 52 can be easily wired to the electromagnet 32 side across the partition wall 44, thereby providing excellent workability.

Application Example

In the above-described embodiment, a configuration has been described in which the substrate 33 is simply inserted into the pair of grooves 47, but the present invention is not limited thereto. Since the substrate accommodating portion 34 is surrounded with the side walls 41, 42, and 43, and the partition wall 44, casting may be performed here using a resin.

Figure 8:
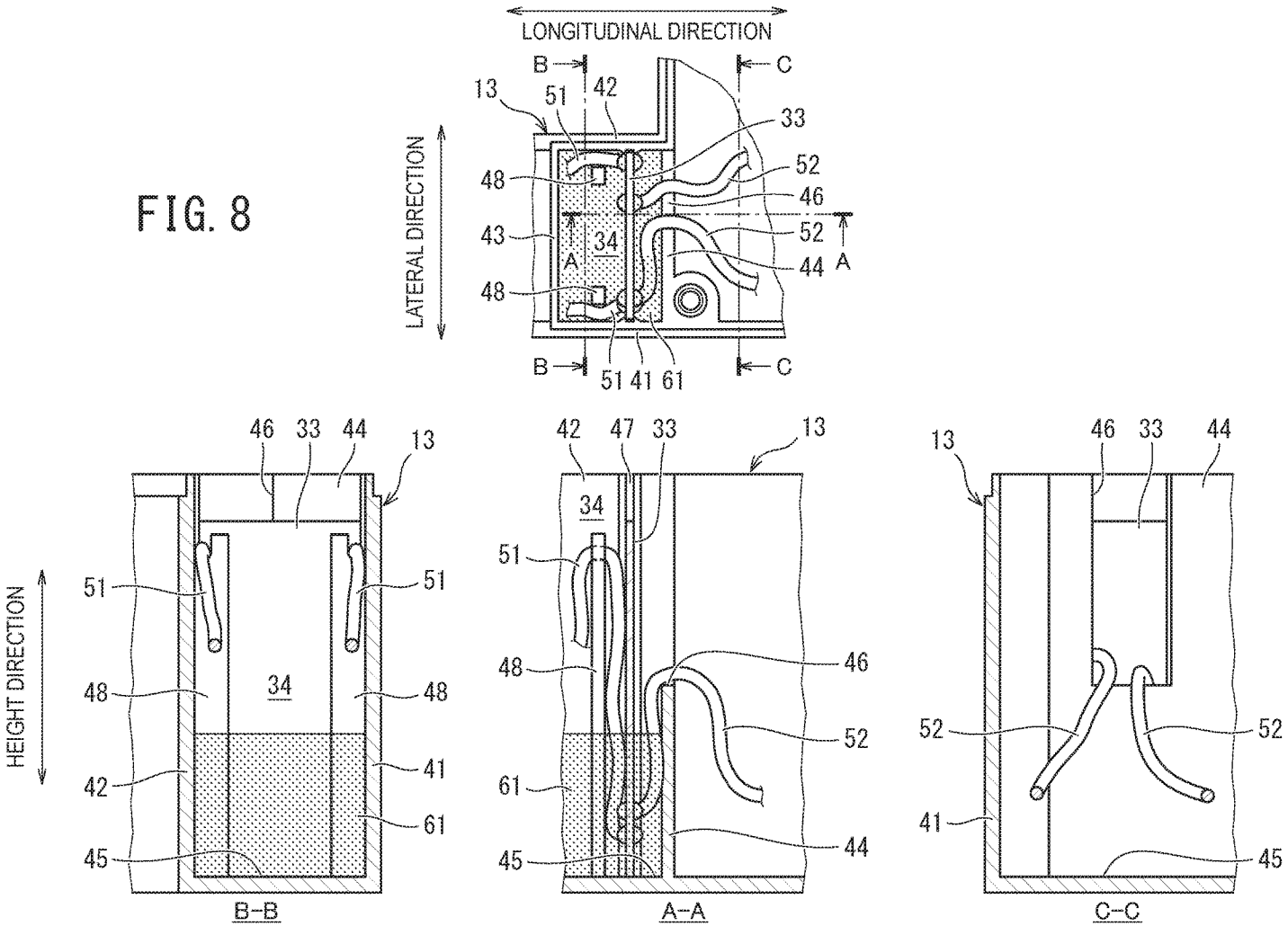
FIG. 8 is a plan view and a sectional view of the substrate accommodating portion in which casting is performed using a resin.

FIG. 8 is a plan view and a sectional view of the substrate accommodating portion in which casting is performed using the resin.

Here, the casting is performed using a resin 61 so as to fill approximately lower half of the substrate 33. If the resin 61 exceeds the opening 46 of the partition wall 44, the resin 61 spills out. Accordingly, the casting is performed from the floor 45 to the lower side of the opening 46. For example, the resin 61 is a silicone resin.

In this way, the casting is performed using the resin 61 on the floor side of the substrate accommodating portion 34, thereby improving vibration resistance and impact resistance. Furthermore, insulating performance is also improved.

A partition wall which is parallel to the lateral direction and the height direction and which is raised from the floor may be formed between the side wall 43 and the substrate 33. For example, as long as the partition wall is located at a height position which does not interfere with an electronic component of the substrate 33, the partition wall can be formed by connecting the lower portions of the pair of ribs 48 to each other. In this way, if the partition wall serving as a barrier is formed between the side wall 43 and the substrate 33, a casting region using the resin 61 can be minimized. Therefore, it is possible to reduce a flow rate of the resin 61.

Modification Example

In the above-described embodiment, the recess 54 of the claw portion 53 is directly brought into contact with the upper end of the substrate 33, but a configuration is not limited thereto. For example, an elastic member such as rubber or a silicone may be interposed between the upper end of the substrate 33 and the recess 54 of the claw portion 53. In this manner, it is possible to effectively restrain rattling or slack of the substrate 33.

In the above-described embodiment, one groove 47 is formed on the inner surface of the side walls 41 and 42 by forming a pair of rail-shaped projections, but a configuration is not limited thereto. For example, the groove may be formed by forming a recess in a portion of the inner surface on each side wall.

In the above-described embodiment, the groove 47 extending from the floor 45 to the upper end is formed on the inner surface of the side walls 41 and 42, but a configuration is not limited thereto. The groove may be formed entirely in the height direction. That is, as long as the substrate 33 can be reliably held, the groove may be formed in a portion in the height direction, for example, in only the lower half of the substrate 33.

In the above-described embodiment, in the recess 49 formed in the rib 48, the U-shaped notch is formed by chamfering the corner at which the side surface and the bottom surface intersect each other. However, without being limited thereto, the corner may be a right angle without being chamfered. The reason is as follows. The corner at which the side surface and the bottom surface intersect each other in the recess 49 is not a protruding external corner, but is a recessed internal corner. Accordingly, there is no possibility that the coating of the lead wire 51 may be damaged even if the lead wire 51 is fitted into the recess 49.

Hitherto, the present invention has been described with reference to the limited number of embodiments. However, the scope of rights is not limited thereto. Those skilled in the art will clearly understand that the embodiment can be modified based on the above-described disclosure.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

REFERENCE SIGNS LIST

11: electromagnetic contactor
12: case
13: lower case
14: upper case
15: mounting hole
21, 22: external coil terminal
23, 24: external main terminal
25, 26: first external auxiliary terminal
27, 28: second external auxiliary terminal
31: contact accommodating portion
32: electromagnet
33: substrate
34: substrate accommodating portion
35: connection conductor
41 to 43: side wall
44: partition wall
45: floor
46: opening
47: groove
48: rib
49: recess
51, 52: lead wire
53: claw portion
54: recess
61: resin

What is claimed is:

1. An electromagnetic contactor comprising:

a contact accommodating portion configured to accommodate a contact, and to be hermetically filled with arc-extinguishing gas;

an electromagnet configured to open and close the contact by using DC excitation of a coil;

a case configured to accommodate the contact accommodating portion and the electromagnet;

an external coil terminal disposed in the case beside the electromagnet; and a substrate accommodated in the case, configured to have a rectifier circuit whose input side is connected to the external coil terminal and whose output side is connected to the coil to output a DC after converting an input AC into the DC, wherein an inner surface of the case has a groove between the electromagnet and the external coil terminal, wherein the substrate is held by being inserted into the groove, wherein the groove includes a pair of grooves extending in a height direction formed in each of facing side walls within the inner surface of the case, and wherein the substrate is held by both end edges being inserted into the pair of grooves.

2. The electromagnetic contactor according to claim 1, further comprising:

an electric cable configured to connect the input side of the substrate and the external coil terminal to each other, wherein the inner surface of the case has a recess into which the electric cable is finable, between the groove and the external coil terminal, and wherein the electric cable is held by being fitted to the recess.

3. The electromagnetic contactor according to claim 1, wherein the inner surface of the case has a partition wall which is raised from a floor, between the electromagnet and the substrate, and a resin is cast on the substrate side from the partition wall.

4. The electromagnetic contactor according to claim 1, wherein the case includes a lower case and an upper case which are separable in the height direction, wherein the groove is formed in the lower case, and wherein an inner side of the upper case has a claw portion which pushes the substrate from above.

5. An electromagnetic contactor comprising:

a contact accommodating portion configured to accommodate a contact, and to be hermetically filled with arc-extinguishing gas;

an electromagnet configured to open and close the contact by using DC excitation of a coil;

a case configured to accommodate the contact accommodating portion and the electromagnet;

an external coil terminal disposed in the case beside the electromagnet;

a substrate accommodated in the case, configured to have a rectifier circuit whose input side is connected to the external coil terminal and whose output side is connected to the coil to output a DC after converting an input AC into the DC; and an electric cable configured to connect the input side of the substrate and the external coil terminal to each other, wherein an inner surface of the case has a groove between the electromagnet and the external coil terminal, wherein the substrate is held by being inserted into the groove, wherein the inner surface of the case has a recess into which the electric cable is fittable, between the groove and the external coil terminal, and wherein the electric cable is held by being fitted to the recess.

6. The electromagnetic contactor according to claim 5, wherein the inner surface of the case has a rib extending in a height direction, between the groove and the external coil terminal, and wherein the recess includes a U-shaped notch which is formed in an upper end of the rib.

7. The electromagnetic contactor according to claim 6, wherein the inner surface of the case has a partition wall which is raised from a floor, between the electromagnet and the substrate, and a resin is cast on the substrate side from the partition wall.

8. The electromagnetic contactor according to claim 6, wherein the case includes a lower case and an upper case which are separable in the height direction, wherein the groove is formed in the lower case, and wherein an inner side of the upper case has a claw portion which pushes the substrate from above.

9. The electromagnetic contactor according to claim 5, wherein the inner surface of the case has a partition wall which is raised from a floor, between the electromagnet and the substrate, and a resin is cast on the substrate side from the partition wall.

10. The electromagnetic contactor according to claim 5, wherein the case includes a lower case and an upper case which are separable in the height direction, wherein the groove is formed in the lower case, and wherein an inner side of the upper case has a claw portion which pushes the substrate from above.

11. An electromagnetic contactor comprising:

a contact accommodating portion configured to accommodate a contact, and to be hermetically filled with arc-extinguishing gas;

an electromagnet configured to open and close the contact by using DC excitation of a coil;

a case configured to accommodate the contact accommodating portion and the electromagnet;

an external coil terminal disposed in the case beside the electromagnet; and a substrate accommodated in the case, configured to have a rectifier circuit whose input side is connected to the external coil terminal and whose output side is connected to the coil to output a DC after converting an input AC into the DC, wherein an inner surface of the case has a groove between the electromagnet and the external coil terminal, wherein the substrate is held by being inserted into the groove, wherein the case includes a lower case and an upper case which are separable in a height direction, wherein the groove is formed in the lower case, and wherein an inner side of the upper case has a claw portion which pushes the substrate from above.

12. The electromagnetic contactor according to claim 11, wherein the inner surface of the case has a partition wall which is raised from a floor, between the electromagnet and the substrate, and a resin is cast on the substrate side from the partition wall.

* * * * *